US010342342B2

(12) United States Patent
Chen et al.

(10) Patent No.: US 10,342,342 B2
(45) Date of Patent: Jul. 9, 2019

(54) FURNITURE ASSEMBLY INCLUDING A SAFETY DEVICE

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/956,093

(22) Filed: Apr. 18, 2018

(65) Prior Publication Data

US 2019/0159594 A1 May 30, 2019

(30) Foreign Application Priority Data

Nov. 27, 2017 (TW) ..... 106141489 A

(51) Int. Cl.

| | |
|---|---|
| ***A47B 88/47*** | (2017.01) |
| ***A47B 88/50*** | (2017.01) |
| ***A47B 88/427*** | (2017.01) |
| ***A47B 88/467*** | (2017.01) |

(52) U.S. Cl.

CPC ..... *A47B 88/50* (2017.01); *A47B 88/427* (2017.01); *A47B 88/467* (2017.01); *A47B 88/47* (2017.01); *A47B 2210/0054* (2013.01); *A47B 2210/0094* (2013.01)

(58) Field of Classification Search

CPC ..... A47B 88/50; A47B 88/53; A47B 88/57; A47B 88/47

See application file for complete search history.

(56) References Cited

U.S. PATENT DOCUMENTS

| | | | | |
|---|---|---|---|---|
| 5,344,226 | A * | 9/1994 | Lee | E05B 65/46 292/163 |
| 5,823,649 | A * | 10/1998 | Hinrichs | E05B 65/0014 312/334.45 |
| 6,250,730 | B1 * | 6/2001 | Roth | E05B 65/0014 312/333 |
| 6,682,158 | B2 * | 1/2004 | Lai | A47B 67/04 312/333 |
| 6,997,527 | B2 * | 2/2006 | Cheng | E05B 65/46 312/332.1 |

(Continued)

*Primary Examiner* — Daniel J Rohrhoff

(74) *Attorney, Agent, or Firm* — Rosenberg, Klein & Lee

(57) ABSTRACT

A furniture assembly includes a first furniture piece, a second furniture piece, and a safety device. The second furniture piece is movable with respect to the first furniture piece. The safety device includes a first fitting and a second fitting. One of the first fitting and the second fitting is detachably coupled to one of the first furniture piece and the second furniture piece, and the other one of the first fitting and the second fitting is located in the other one of the first furniture piece and the second furniture piece. When the second fitting is at the stop position, the second fitting blocks the first fitting, thereby stopping the second furniture piece from moving in a direction with respect to the first furniture piece.

17 Claims, 13 Drawing Sheets

(56) References Cited

U.S. PATENT DOCUMENTS

| | | | | |
|---|---|---|---|---|
| 7,344,209 | B1 * | 3/2008 | Miyashiro | E05B 65/0014 312/333 |
| 8,056,989 | B2 * | 11/2011 | Zielinski | E05B 65/0014 292/84 |
| 8,100,487 | B2 | 1/2012 | Liang et al. | |
| 8,172,345 | B2 | 5/2012 | Liang et al. | |
| 8,308,251 | B2 | 11/2012 | Liang et al. | |
| 8,523,301 | B1 * | 9/2013 | Britson | E05B 65/46 312/333 |
| 8,727,460 | B2 * | 5/2014 | Grabher | E05F 5/02 312/333 |
| 2008/0231156 | A1 * | 9/2008 | Hoshide | A47B 88/467 312/334.46 |

* cited by examiner

FURNITURE ASSEMBLY INCLUDING A SAFETY DEVICE

BACKGROUND OF INVENTION

1. Field of the Invention

The present invention relates to a furniture assembly, and more particularly to the furniture assembly including a safety device.

2. Description of Related Art

Generally speaking, the furniture or equipment in daily life have a fixed part and a moving part which can move with respect to the fixed part (e.g. fixed rail and moving rail, drawer and cabinet or door and fixed frame). When the furniture encounters an unexpected condition (e.g. earthquake), if the vibration or shaking force is too strong, the moving part of the furniture is usually opened with respect to the fixed part automatically, and this situation may injure the persons nearby the furniture or damage objects.

Therefore, it is imperative to develop a furniture assembly that includes a safety mechanism.

SUMMARY OF THE INVENTION

The present invention relates to a furniture assembly including a safety device.

According to a view of the present invention, a furniture assembly includes a first furniture piece, a second furniture piece and a safety device. The second furniture piece is movable with respect to the first furniture piece. The safety device includes a first fitting and a second fitting. At least one of the first fitting and the second fitting is coupled to a corresponding one of the first furniture piece and the second furniture piece in a detachable manner. The second fitting blocks the first fitting while at a stop position, thereby stopping the second furniture piece from moving in a first direction with respect to the first furniture piece.

Preferably, each of the first and second fittings is detachably coupled to a corresponding one of the first and second furniture pieces. However, in an alternative embodiment, only one of the first and second fittings is coupled to one of the first and second furniture pieces in a detachable manner, and the other one of the first and second fittings is located on the other one of the first and second furniture pieces.

Preferably, the second fitting is detachably coupled to the corresponding one of the first furniture piece and the second furniture piece through a mounting base.

Preferably, the second fitting is movably arranged on the mounting base.

Preferably, the safety device includes a first component, a second component, and an actuating piece arranged on the mounting base. The second component and the first component are movable relatively. The actuating piece is located in one of the first component and the second component and is movable from a first position to a second position responsive to the relative movement of the first component and the second component, so as to drive the second fitting to move from an initial position to the stop position.

Preferably, the direction of relative movement of the first component and the second component is different from the direction of displacement of the actuating piece from the first position to the second position.

Preferably, the second fitting includes a guide section through which the actuating piece can drive the second fitting to move. The guide section is a bevel face or a cambered surface.

Preferably, the first fitting includes a first stopping part and a second stopping part, and a space is defined between the first stopping part and the second stopping part. When the second fitting is at the stop position, a portion of the second fitting protrudes into the space and thereby blocks one of the first stopping part and the second stopping part.

Preferably, when the second furniture piece is moved in a second direction to a predetermined position with respect to the first furniture piece, the other one of the first stopping part and the second stopping part contacts the second fitting and drives the second fitting to depart from the stop position.

Preferably, the second fitting includes a guide feature through which the other one of the first stopping part and the second stopping part can drive the second fitting to depart from the stop position. The guide feature is a bevel face or a cambered surface.

According to another view of the present invention, a furniture assembly includes a first furniture piece, a second furniture piece and a safety device. The second furniture piece is movable with respect to the first furniture piece. The safety device includes a first fitting and a second fitting. One of the first fitting and the second fitting is detachably attached to one of the first furniture piece and the second furniture piece, and the other one of the first fitting and the second fitting is located in the other one of the first furniture piece and the second furniture piece. The first fitting includes a first stopping part and a second stopping part, and a space is defined between the first stopping part and the second stopping part. When the second furniture piece is in a closing position with respect to the first furniture piece, the second stopping part of the first fitting corresponds in position to a portion of the second fitting, so that the second fitting is kept at an initial position. When the second furniture piece is moved in a first direction with respect to the first furniture piece due to a force applied on the furniture assembly and thereby leaves the closing position, the second stopping part of the first fitting does not correspond in position to the portion of the second fitting anymore, so that the second fitting moves from the initial position to a stop position responsive to the force, and that the portion of the second fitting protrudes into the space of the first fitting to block the first stopping part, thereby stopping the second furniture piece from moving in the first direction with respect to the first furniture piece.

Preferably, when the second furniture piece moves in a second direction to a predetermined position with respect to the first furniture piece, the second stopping part contacts the portion of the second fitting and drives the second fitting to return from the stop position to the initial position.

DETAILED DESCRIPTION OF THE INVENTION

Figure 1:
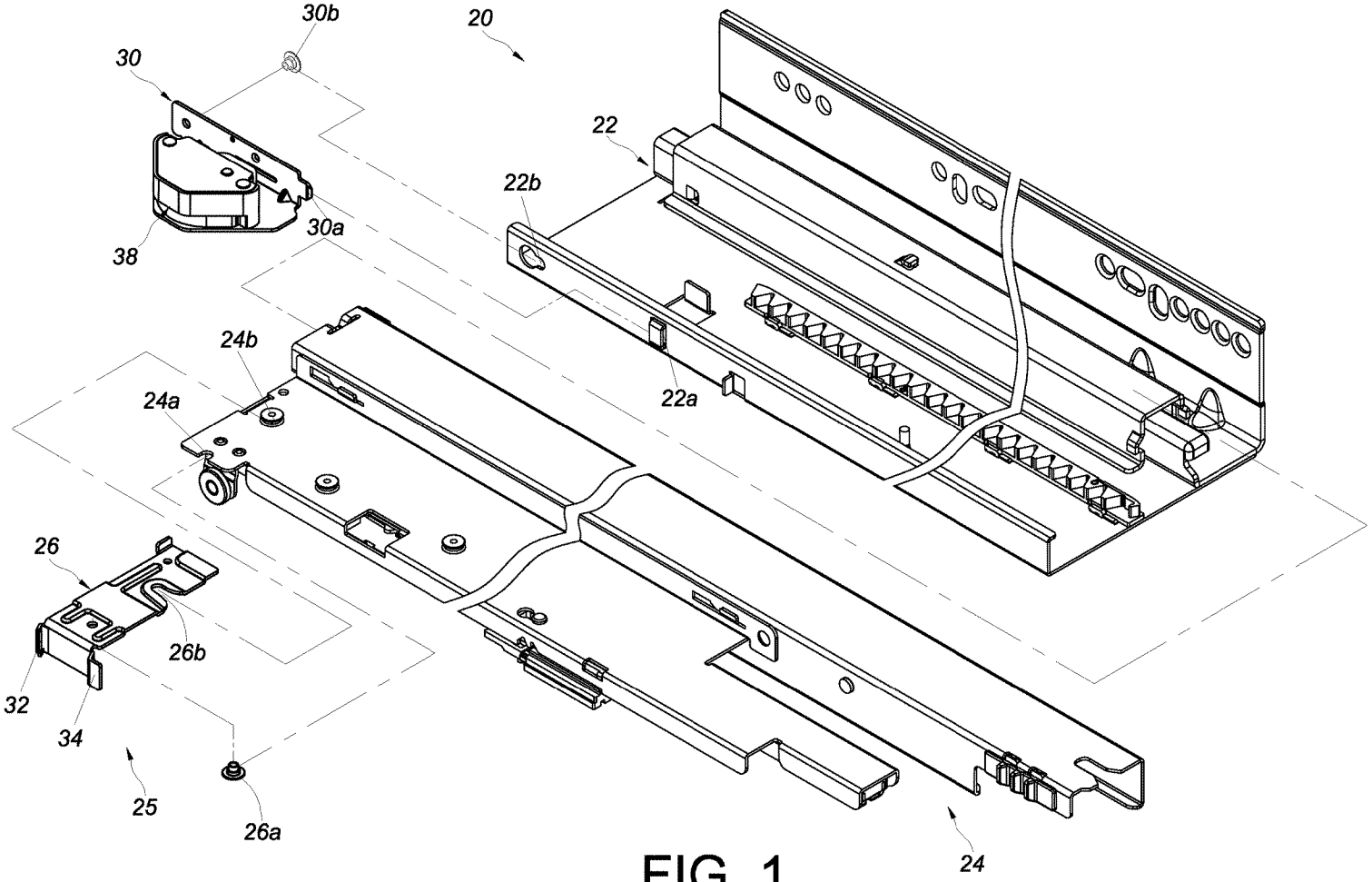
FIG. 1 is an exploded view of the furniture assembly in an embodiment of the present invention.
Figure 2:
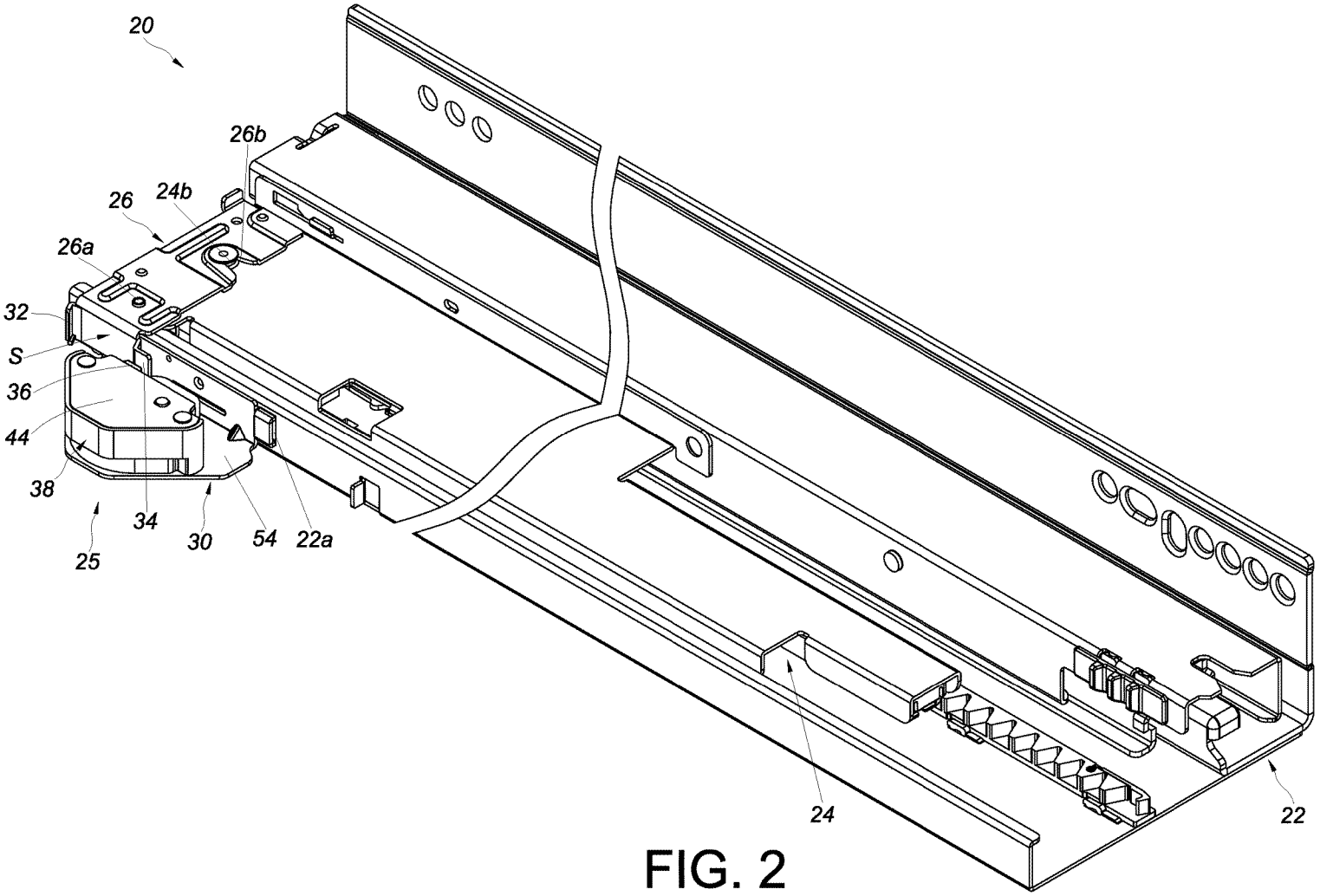
FIG. 2 is an assembled view of the furniture assembly in an embodiment of the present invention.

FIG. 1 and FIG. 2 show a furniture assembly 20 according to an embodiment of the present invention, e.g. a slide rail assembly for furniture. The furniture assembly 20 includes a first furniture piece 22 (e.g. a fixed rail), a second furniture piece 24 (e.g. a moving rail) and a detachable safety device 25.

The second furniture piece 24 is movable with respect to the first furniture piece 22. The safety device 25 includes a first fitting 26. The first fitting 26 is detachably coupled to one of the first furniture piece 22 and the second furniture piece 24. The first fitting 26 detachably coupled to the second furniture piece 24 is herein taken as an example. To be specific, the first fitting 26 is provided with a first part 26*a* and a second part 26*b*, and the second furniture piece 24 is provided with a first feature 24*a* and a second feature 24*b*. The first part 26*a* and the first feature 24*a* may be assembled by inserting, clamping, mechanical engagement, or any other suitable means, and the second part 26*b* and the second feature 24*b* may be assembled by inserting, clamping, mechanical engagement, or any other suitable means.

Preferably, the safety device 25 includes a mounting base 30. The mounting base 30 is detachably coupled to the other one of the first furniture piece 22 and the second furniture piece 24. The mounting base 30 detachably coupled to the first furniture piece 22 is herein taken as an example. To be specific, the mounting base 30 is provided with a first part 30*a* and a second part 30*b*. The first furniture piece 22 is provided with a first feature 22*a* and a second feature 22*b*. The first part 30*a* and the first feature 22*a* may be assembled by inserting, clamping, mechanical engagement, or any other suitable means. The second part 30*b* and the second feature 22*b* may be assembled by inserting, clamping, mechanical engagement, or any other suitable means.

Figure 3:
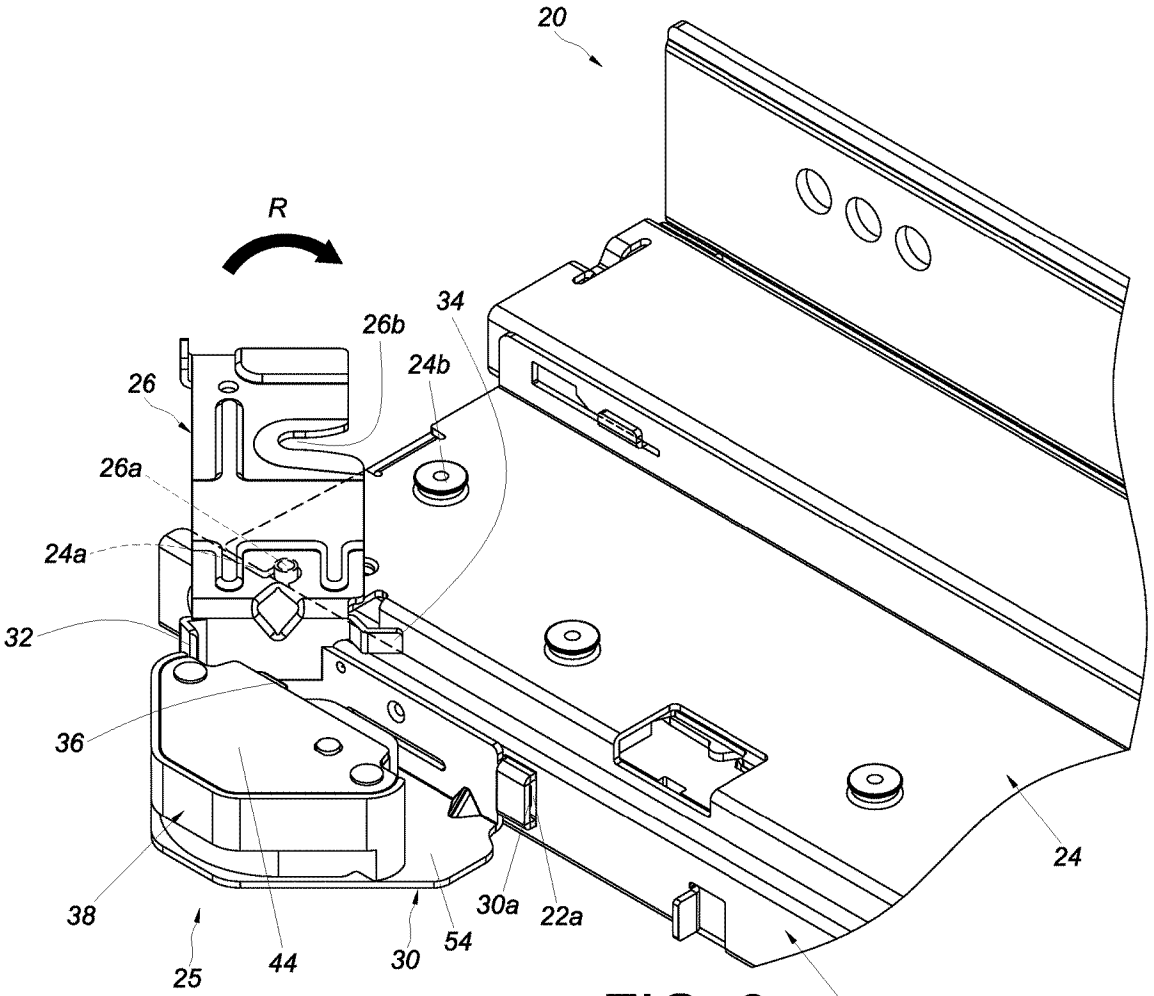
FIG. 3 is a diagrammatic view showing how the fitting of the safety device is mounted to the furniture assembly in an embodiment of the present invention.
Figure 4:
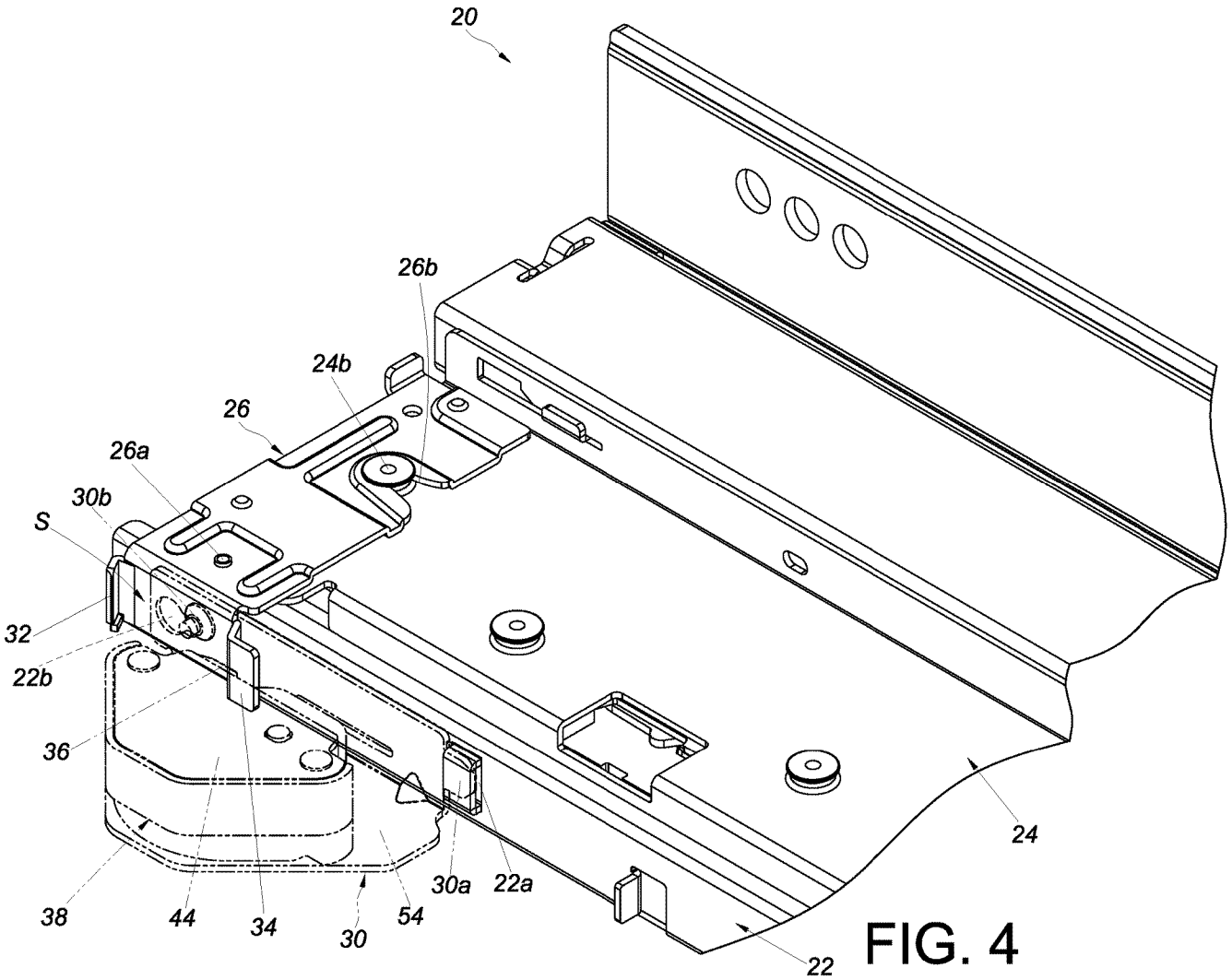
FIG. 4 is a diagrammatic view of the furniture assembly in an embodiment of the present invention, with a safety device mounted thereto.

As shown in FIG. 3 and FIG. 4, to fix the mounting base 30 to the first furniture piece 22, the user may insert the first part 30*a* (e.g. a protruding part) of the mounting base 30 in the first feature 22*a* (e.g. a hole) of the first furniture piece 22, and may clamp or engage the second part 30*b* (e.g. a protruding part) of the mounting base 30 with the second feature 22*b* (e.g. a hole) of the first furniture piece 22. On the other hand, to mount the first fitting 26 to the second furniture piece 24, the user may clamp or engage the first part 26*a* (e.g. a protruding part) of the first fitting 26 with the first feature 24*a* (e.g. a notch) of the second furniture piece 24, and may clamp or engage the second part 26*b* (e.g. a notch) of the first fitting 26 with the second feature 24*b* (e.g. a protruding part) of the second furniture piece 24. In a preferred installation method, the user may clamp or engage the first part 26*a* of the first fitting 26 with the first feature 24*a* of the second furniture piece 24, and subsequently rotate the first fitting 26 in a rotation direction R for an angle, so as to clamp or engage the second part 26*b* of the first fitting 26 with the second feature 24*b* of the second furniture piece 24. Thanks to the first part 26*a* and the second part 26*b* of the first fitting 26, the firmness and reliability of the first fitting 26 mounted to the second furniture piece 24 are enhanced. Similarly, thanks to first part 30*a* and the second part 30*b* of the mounting base 30, the firmness and reliability of the mounting base 30 mounted to the first furniture piece 22 can be enhanced.

Preferably, the first fitting 26 includes a first stopping part 32 and a second stopping part 34, and a space S is defined between the first stopping part 32 and the second stopping part 34. Preferably, the safety device 25 further includes a second fitting 36. The second fitting 36 is detachably coupled to the other one of the first furniture piece 22 and the second furniture piece 24. By way of example, the second fitting 36 is movably arranged on the mounting base 30 and detachably coupled to the first furniture piece 22 through the mounting base 30. It is worth mentioning that the second fitting 36 and the first fitting 26 in this embodiment are both coupled to the furniture assembly 20 in a detachable manner, but in an alternative embodiment, only one of the first fitting 26 and the second fitting 36 is coupled to the furniture assembly 20 in the detachable manner. The purpose of coupling the fittings in such detachable manner is to allow the user to decide whether or not to increase the function of safety device as required.

Figure 5:
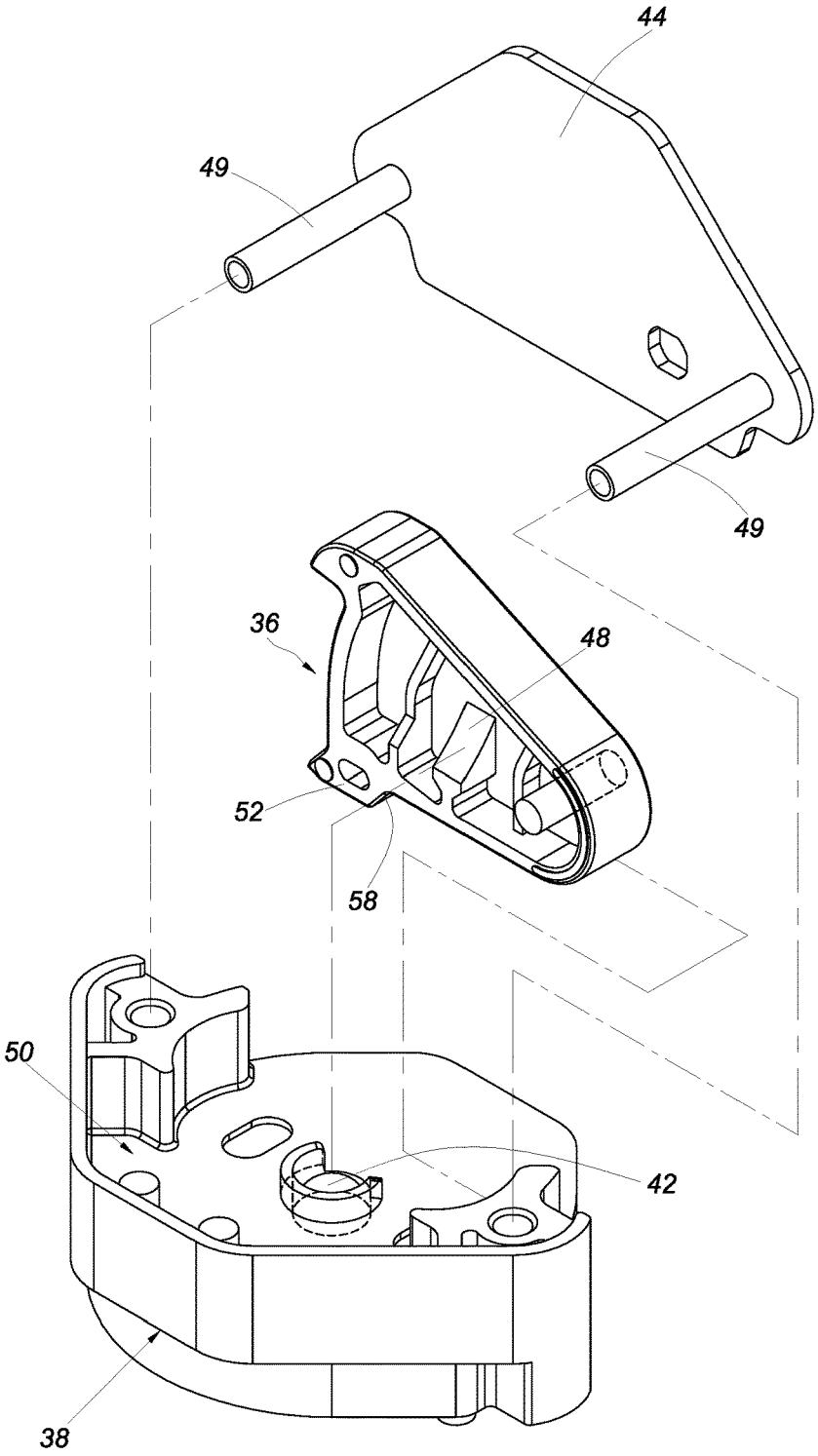
FIG. 5 is an exploded view of the safety kit of the safety device in an embodiment of the present invention.
Figure 6:
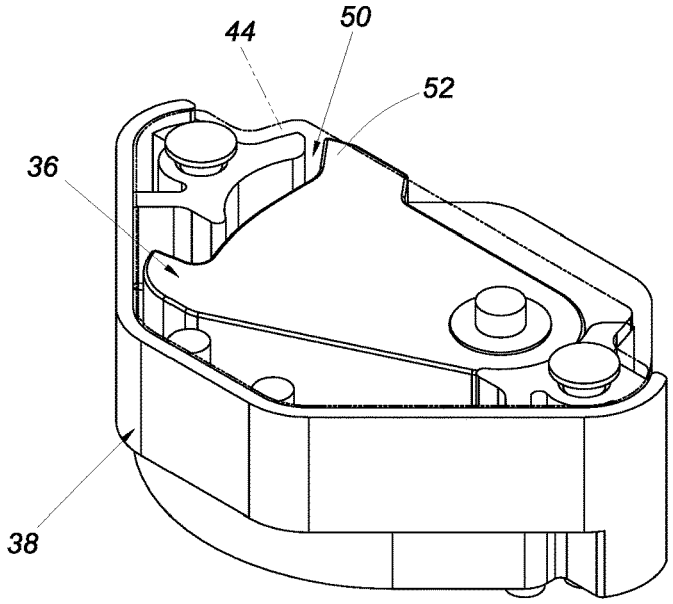
FIG. 6 is an assembled view of the safety kit of the safety device in an embodiment of the present invention.
Figure 7:
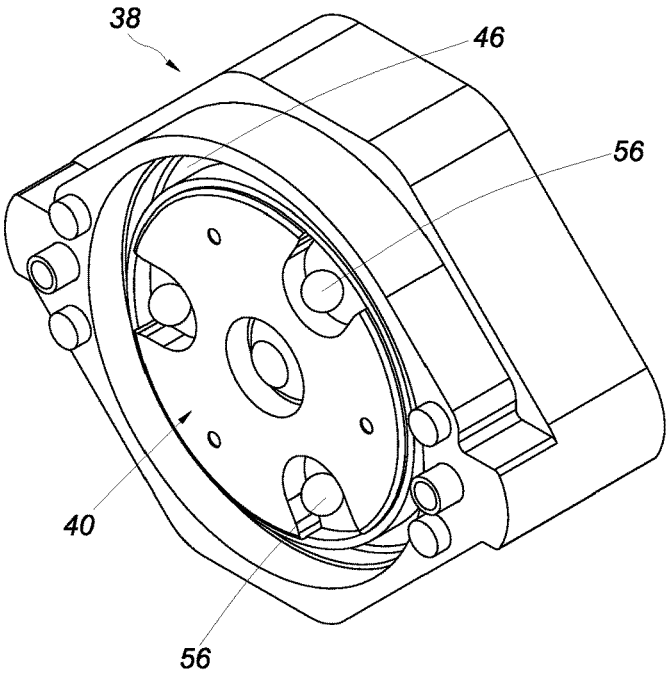
FIG. 7 is an assembled view in another viewing angle of the safety kit of the safety device in an embodiment of the present invention.

As shown in FIG. 5, FIG. 6 and FIG. 7, the safety device 25 includes a first component 38, a second component 40 and an actuating piece 42. The first component 38, the second component 40, the actuating piece 42 and the second fitting 36 compose a safety kit. Preferably, the safety kit further includes a cover body 44.

The first component 38 and the second component 40 can move relatively. One of the first component 38 and the second component 40 has a receiving room 46 for receiving the other one. Here, the receiving room 46 is located at the bottom of the first component 38 for receiving the second component 40 by way of example (as shown in FIG. 7). Preferably, the second fitting 36 is movably mounted on the top of the first component 38 (as shown in FIG. 6). For example, the second fitting 36 is pivotally connected to the first component 38. The second fitting 36 includes a guide section 48 (e.g. a bevel face or a cambered surface) corresponding in position to the actuating piece 42. The actuating piece 42 (e.g. a sphere) is located in one of the first component 38 and the second component 40. Preferably, the cover body 44 is connected to the first component 38 through at least one connecting piece 49, and a mounting space 50 is defined between the cover body 44 and the first component 38. The second fitting 36 is mostly received in the mounting space 50, and the cover body 44 can protect the second fitting 36.

Figure 8:
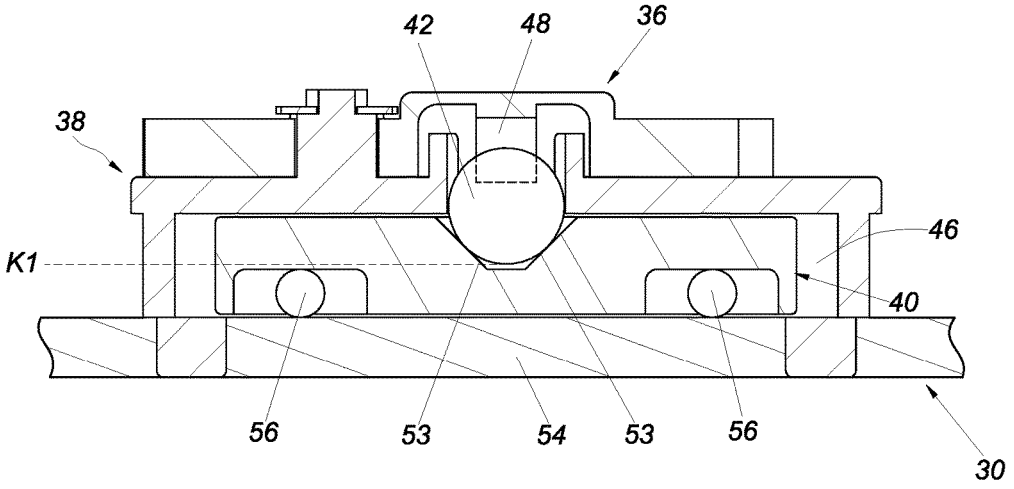
FIG. 8 is a diagrammatic view of the safety kit of the safety device in an embodiment of the present invention, wherein the safety kit is mounted on a mounting base.
Figure 9:
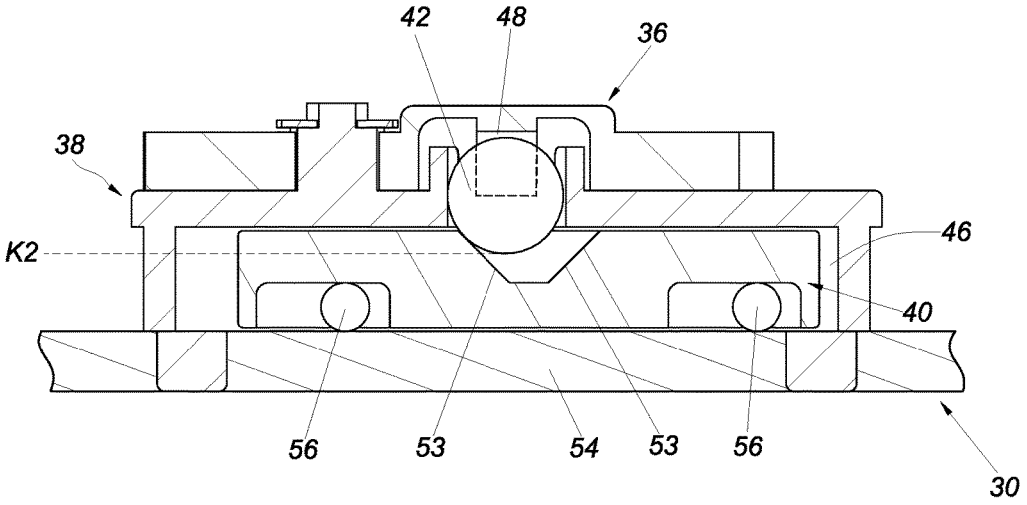
FIG. 9 is a diagrammatic view showing that the second component of the safety device in an embodiment of the present invention is movable with respect to the first component of the safety device.

As shown in FIG. 8 and FIG. 9, the actuating piece 42 can move from a first position K1 to a second position K2 responsive to relative movement of the first component 38 and the second component 40, so as to drive the second fitting 36 to move. Preferably, one of the first component 38 and the second component 40 includes an actuating part 53, the actuating part 53, e.g. a bevel face or a cambered surface, contributes to driving the actuating piece 42. Preferably, the actuating piece 42 is helpful to driving the second fitting 36 through the guide section 48. Preferably, the mounting base 30 includes a supporting part 54, and the first component 38, the second component 40, the actuating piece 42 and the second fitting 36 are placed on the supporting part 54 of the mounting base 30.

In this embodiment, the supporting part 54 is located at the bottom of the second component 40 by way of example. Preferably, there are plural slide assisting pieces 56 (e.g. balls) contribute to the movement of the second component 40 with respect to the first component 38. In addition, the direction of relative movement of the first component 38 and the second component 40 is different from the direction of displacement of the actuating piece 42 from the first position K1 to the second position K2. For example, the second component 40 moves to the left or right with respect to the first component 38, while the actuating piece 42 is from bottom to top.

Figure 10:
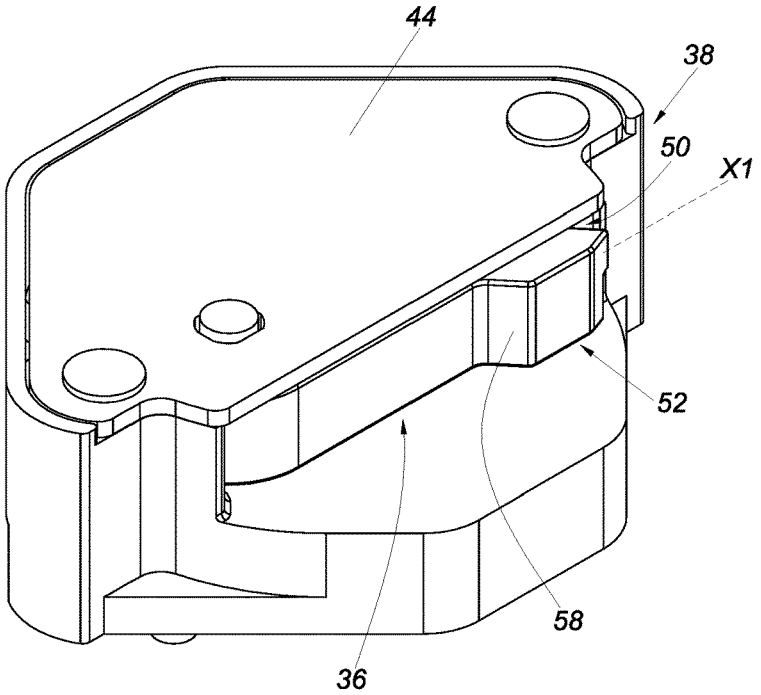
FIG. 10 is a diagrammatic view of the second fitting of the safety device in an embodiment of the present invention, wherein the second fitting is at an initial position.
Figure 11:
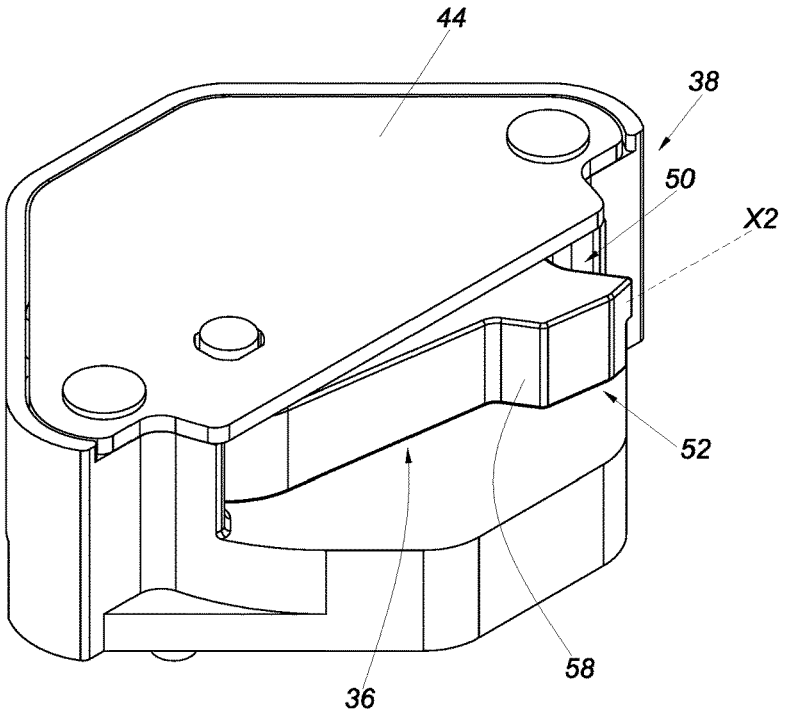
FIG. 11 is a diagrammatic view of the second fitting of the safety device in an embodiment of the present invention, wherein the second fitting is at a stop position.

As shown in FIG. 10 and FIG. 11, the actuating piece 42 can drive the second fitting 36 to move responsive to the relative movement of the first component 38 and the second component 40, so that a portion 52 of the second fitting 36 can depart from the mounting space 50. For example, the second fitting 36 can be driven by the actuating piece 42 to move from an initial position X1 to a stop position X2, so that the portion 52 of the second fitting 36 is away from the mounting space 50. Preferably, the portion 52 has a guide feature 58 (e.g. a bevel face or a cambered surface).

Figure 13:
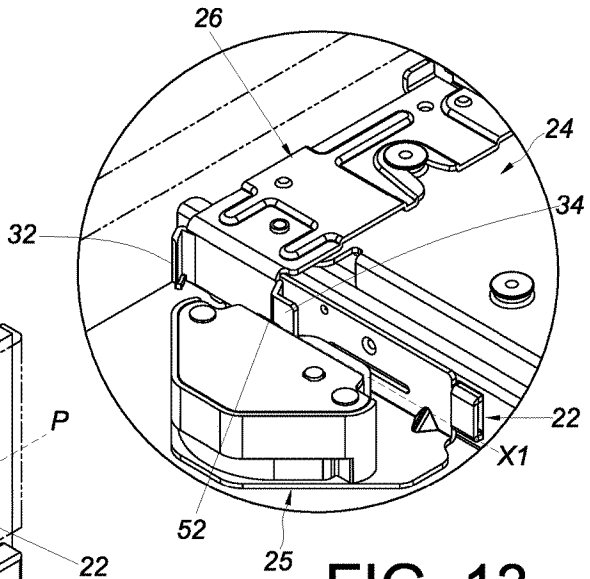
FIG. 13 is an enlarged view of the circled area A in FIG. 12.
Figure 12:
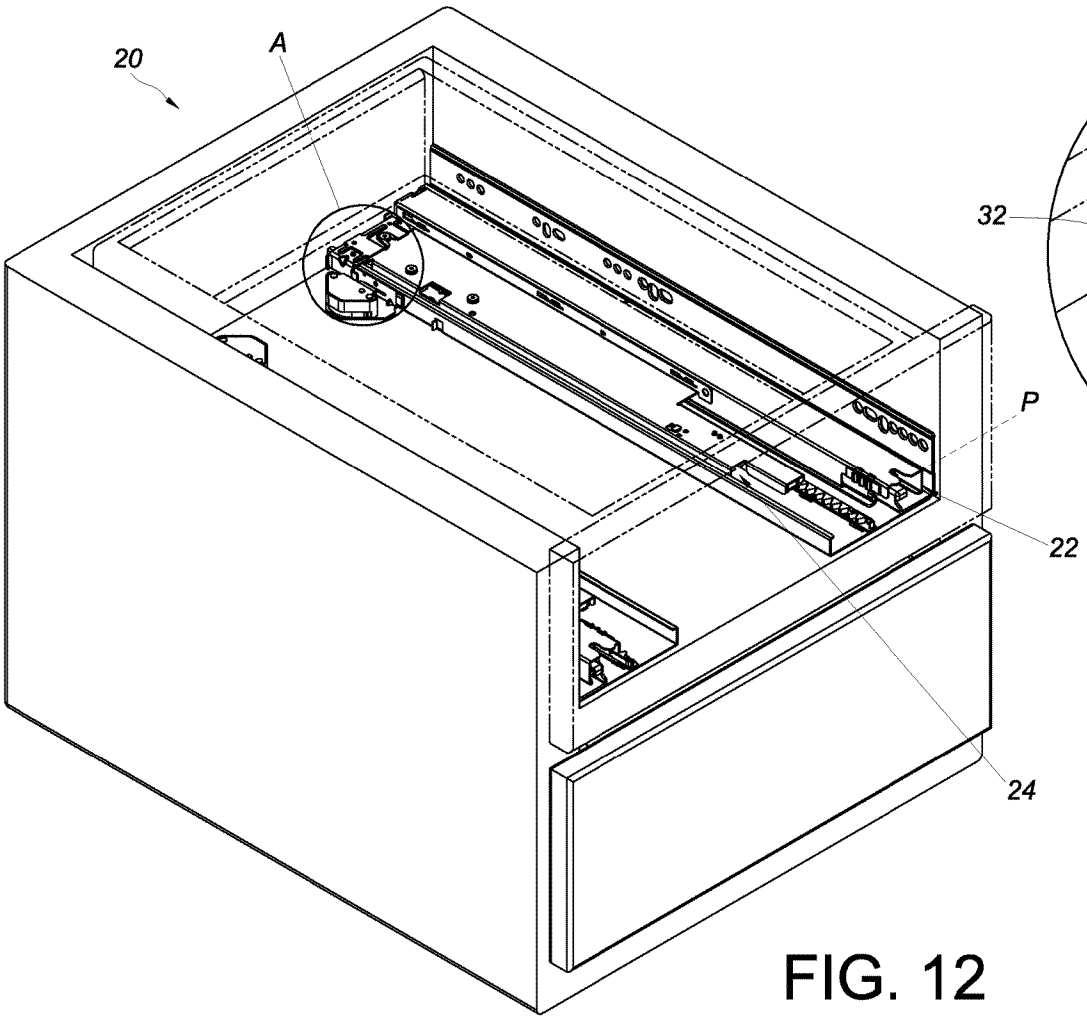
FIG. 12 is a perspective diagrammatic view showing the furniture assembly in an embodiment of the present invention, wherein the furniture assembly is in an initial state.

As shown in FIG. 12 and FIG. 13, the first furniture piece 22 is fixed to a cabinet body, and the cabinet body can be regarded as the first furniture piece 22. On the other hand, the second furniture piece 24 bears a drawer, and the drawer can be regarded as the second furniture piece 24.

In an embodiment, when the second furniture piece 24 is in a closing position P with respect to the first furniture piece 22, the second stopping part 34 of the first fitting 26 corresponds in position to the portion 52 of the second fitting 36, so that the second fitting 36 is kept in the initial position X1.

Figure 15:
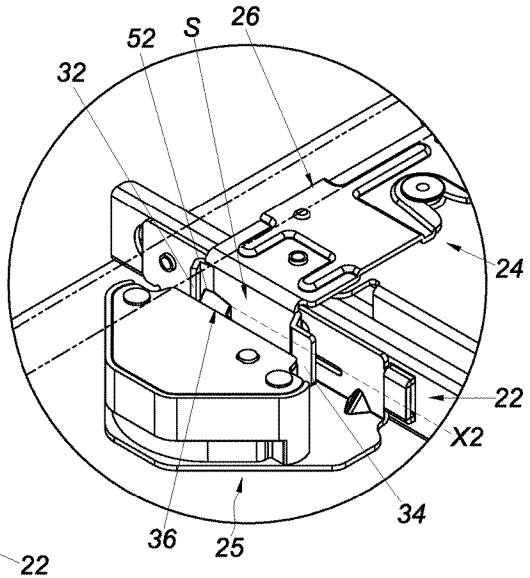
FIG. 15 is an enlarged view of the circled area A in FIG. 14.
Figure 14:
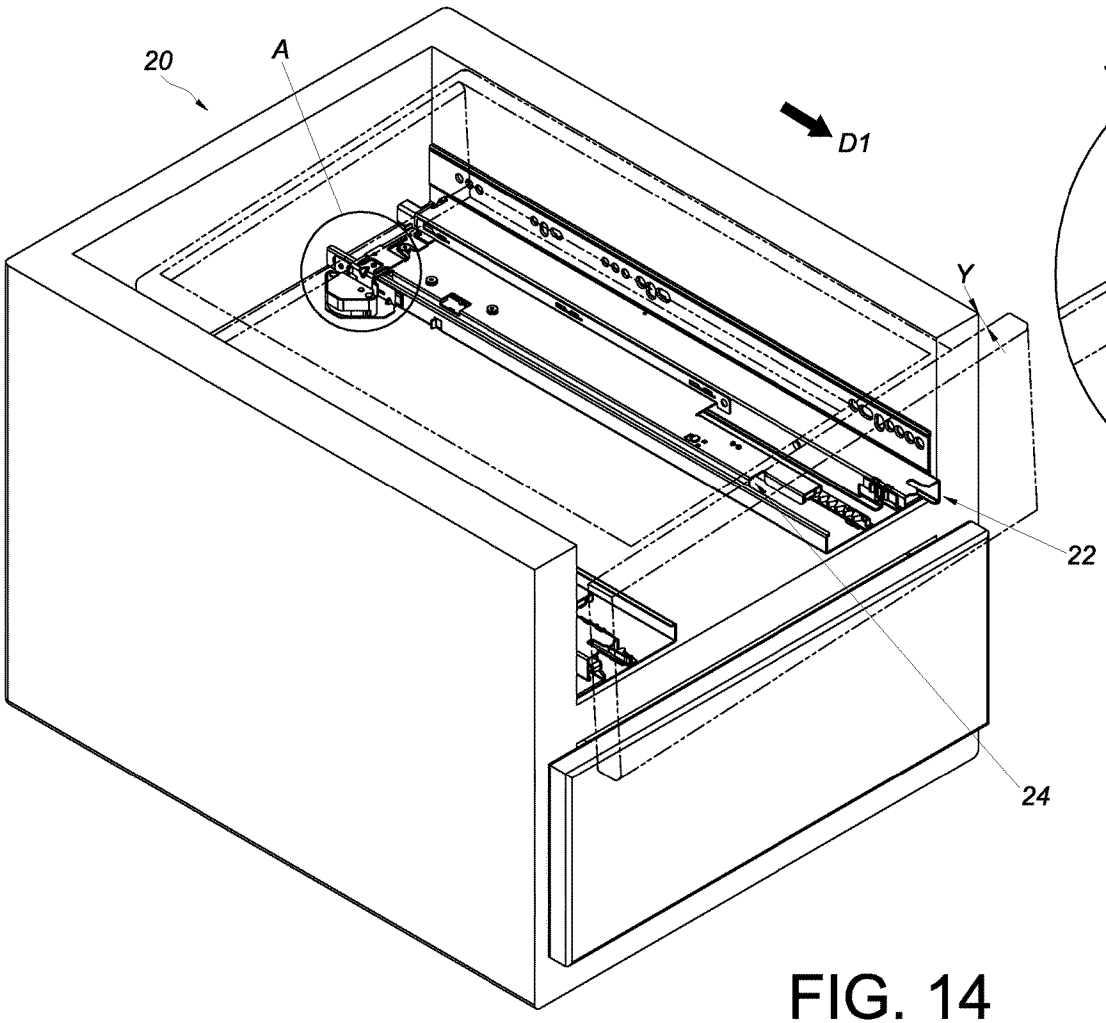
FIG. 14 is a perspective diagrammatic view showing the furniture assembly in an embodiment of the present invention, wherein the furniture assembly is in a state of being vibrated or shaken by a force.

As shown in FIG. 14 and FIG. 15, when the furniture assembly 20 receives a force (e.g. a vibration force or a sloshing force), the second furniture piece 24 (the drawer) or the first furniture piece 22 (the cabinet body) may be vibrated or shaken (in FIG. 15, this vibration force or sloshing force is represented by a certain angle Y). Therefore, the second furniture piece 24 moves in a first direction D1 (e.g. opening direction) with respect to the first furniture piece 22 and departs from the closing position P, and the second stopping part 34 of the first fitting 26 does not correspond in position to the portion 52 of the second fitting 36 anymore, so that the second fitting 36 can move from the initial position X1 to the stop position X2 responsive to the force (e.g. the vibration force or the sloshing force), and the portion 52 of the second fitting 36 can protrude into the space S of the first fitting 26 to block the first stopping part 32, so as to stop the second furniture piece 24 from moving in the first direction D1 with respect to the first furniture piece 22.

Such a characteristic is that once the furniture assembly 20 encounters an earthquake or is handled and shaken, the safety device 25 can prevent arbitrary movement of the second furniture piece 24 with respect to the first furniture piece 22, so as to avoid injuring the persons by the furniture assembly 20 to guarantee the persons' safety.

Figure 16:
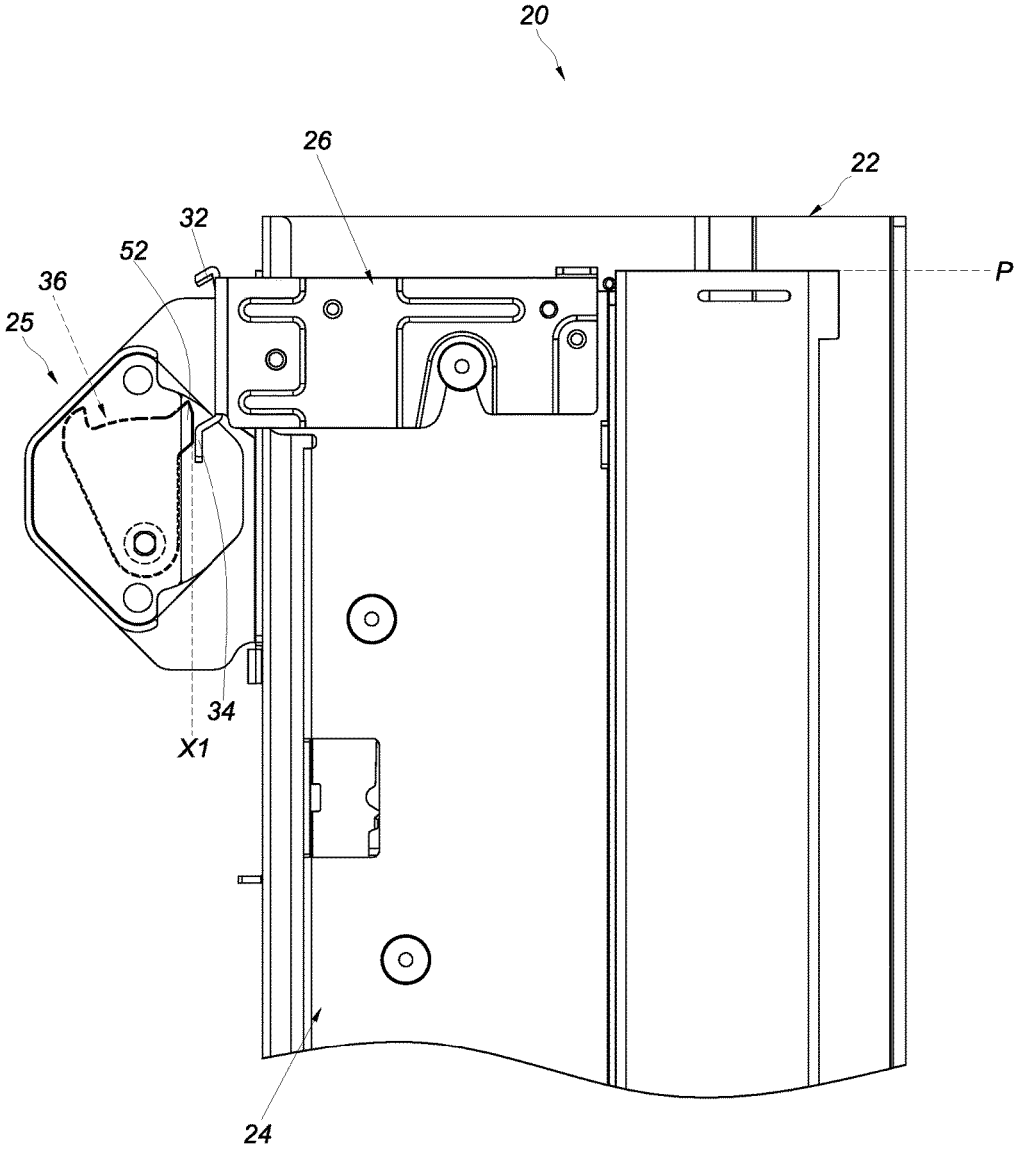
FIG. 16 is a diagrammatic view of the furniture assembly in an embodiment of the present invention.

As shown in FIG. 16, when the second furniture piece 24 is in the closing position P with respect to the first furniture piece 22, the second stopping part 34 of the first fitting 26 corresponds in position to the portion 52 of the second fitting 36, so that the second fitting 36 is kept in the initial position X1.

Figure 17:
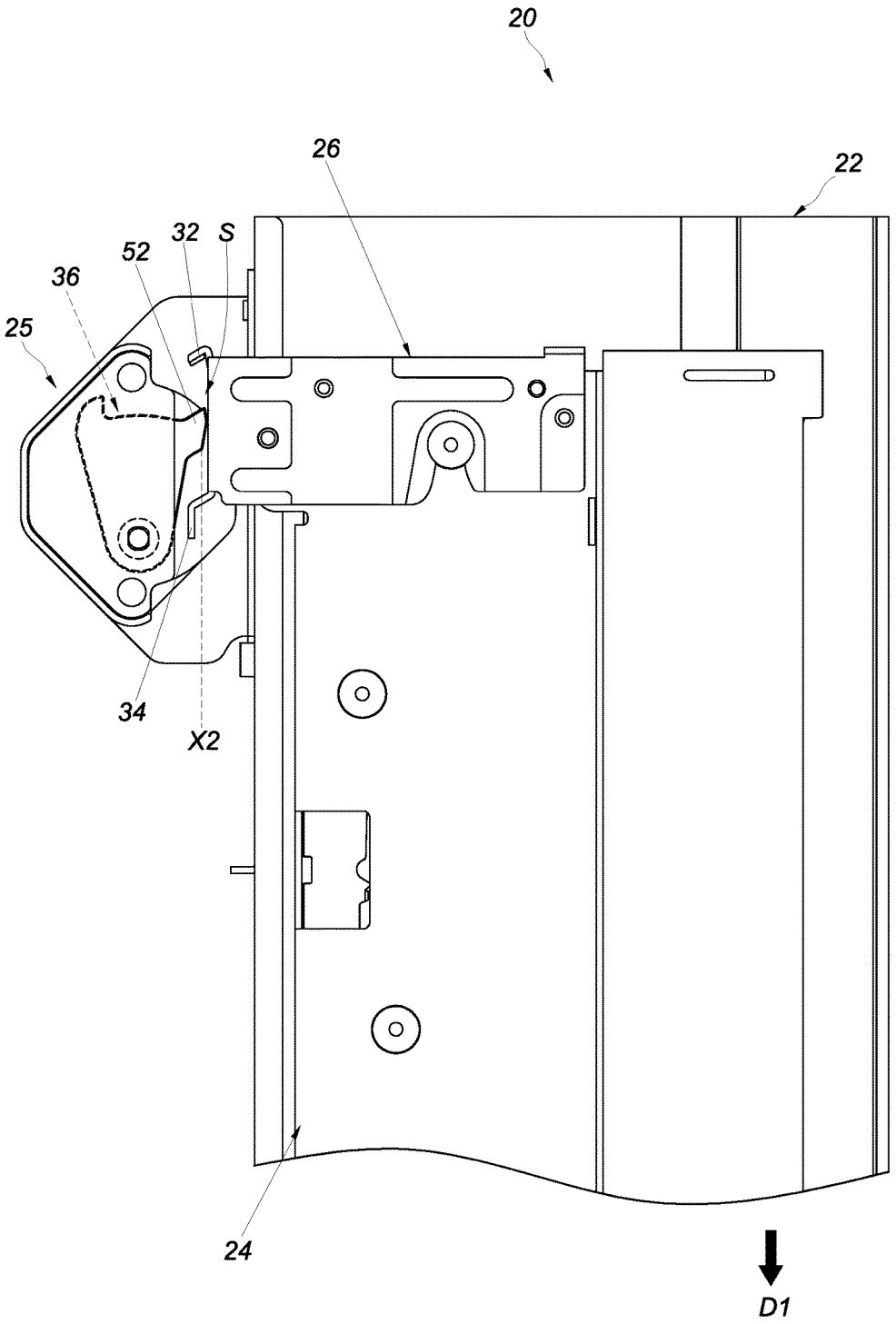
FIG. 17 is a diagrammatic view showing that the second furniture piece of the furniture assembly in an embodiment of the present invention moves in a certain direction with respect to the first furniture piece of the furniture assembly.
Figure 18:
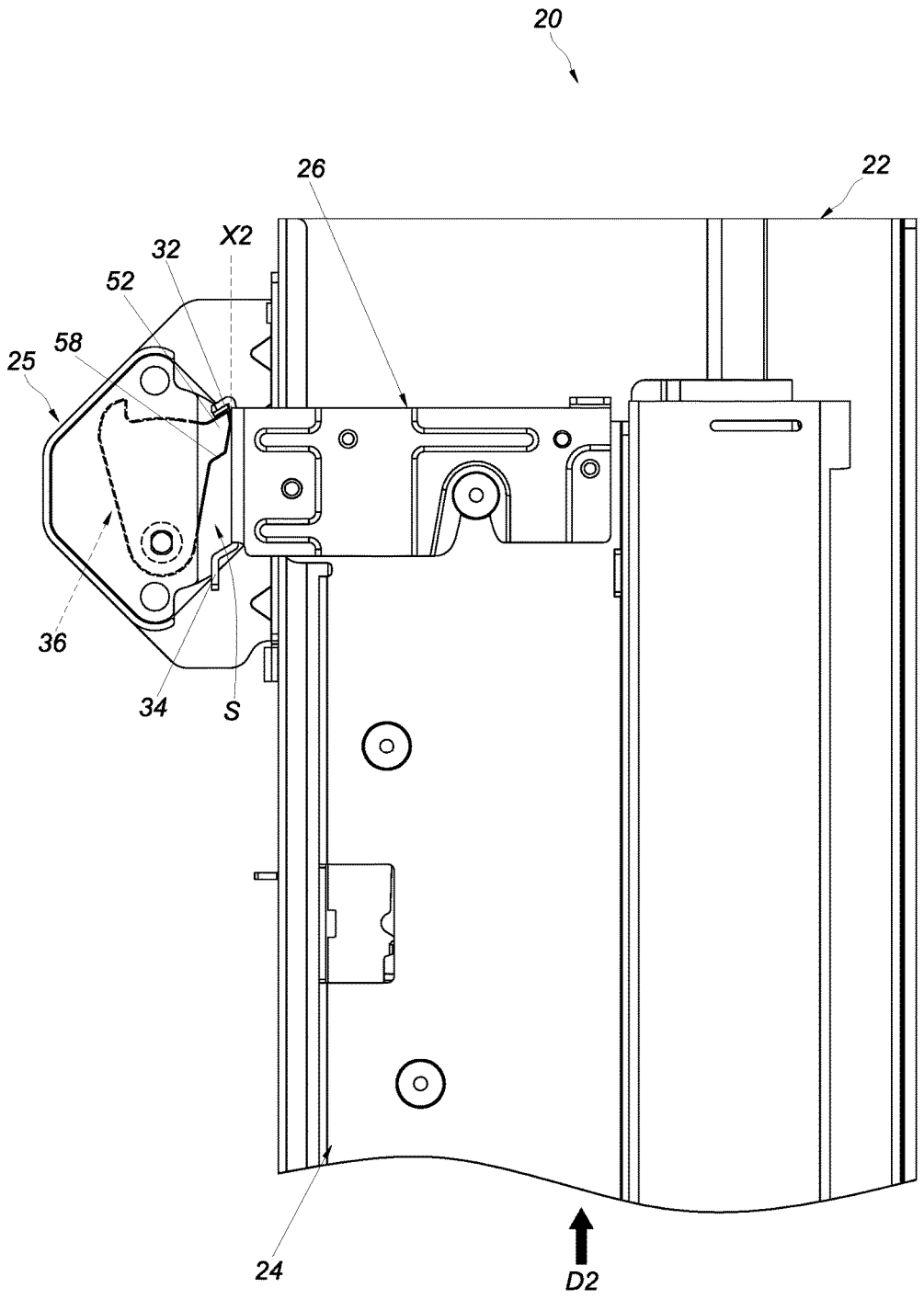
FIG. 18 is a diagrammatic view showing how the safety device stops the second furniture piece of the furniture assembly in an embodiment of the present invention from moving in the certain direction with respect to the first furniture piece of the furniture assembly.

As shown in FIG. 17 and FIG. 18, once the furniture assembly 20 receives the aforementioned force (e.g. the vibration force or the sloshing force), the second furniture piece 24 moves in the first direction D1 with respect to the first furniture piece 22, and the second stopping part 34 of the first fitting 26 therefore does not correspond in position to the portion 52 of the second fitting 36 anymore, so that the second fitting 36 can move from the initial position X1 to the stop position X2 responsive to the force (e.g. the vibration force or the sloshing force), and the portion 52 of the second fitting 36 can protrude into the space S of the first fitting 26 to block the first stopping part 32, so as to stop the second furniture piece 24 from moving in the first direction D1 with respect to the first furniture piece 22.

It is noteworthy that, as shown in FIG. 18, when the portion 52 of the second fitting 36 blocks the first stopping part 32, to cancel the aforementioned stop mechanism, the user can apply a force to displace the second furniture piece 24 to a predetermined position in a second direction D2 (e.g. closing direction) with respect to the first furniture piece 22, so that the second stopping part 34 of the first fitting 26 can contact and drive the second fitting 36 to depart from the stop position X2 through the guide feature 58 of the second fitting 36, and the second fitting 36 thereby returns to the initial position X1 (see FIG. 16 for this part).

Therefore, the furniture assembly according to the embodiments of the present invention preferably includes the following characteristics:

1. At least one of the fittings of safety device is detachably coupled to the furniture assembly 20, so that users can decide whether or not to mount the fittings of safety device to the furniture related objects as required.
2. Once the furniture assembly 20 encounters an earthquake or is handled and shaken, the safety device bears the vibration force or sloshing force and thereby prevent arbitrary movement of relevant objects (e.g. the second furniture piece 24 with respect to the first furniture piece 22), so as to avoid injuring the persons by the furniture assembly 20 to guarantee the persons' safety.

3. The safety device can be used for the push-open drawers to prevent the push-open drawer from unexpected ejection resulted from vibration or shaking, so as to avoid injuring the persons by the furniture assembly 20.

Although the present invention has been described in terms of specific exemplary embodiments and examples, it will be appreciated that the embodiments disclosed herein are for illustrative purposes only and various modifications and alterations might be made by those skilled in the art without departing from the spirit and scope of the invention as set forth in the following claims.

What is claimed is:

1. A furniture assembly, comprising:

a first furniture piece;

a second furniture piece movable with respect to the first furniture piece; and a safety device, including:

a first fitting detachably coupled to one of the first furniture piece and the second furniture piece; and a second fitting detachably coupled to the other one of the first furniture piece and the second furniture piece;

wherein when the second fitting is at a stop position, the first fitting is blocked by the second fitting so that the second furniture piece is stopped from moving in a first direction with respect to the first furniture piece;

wherein the second fitting is detachably coupled to the other one of the first furniture piece and the second furniture piece through a mounting base;

wherein the safety device further includes a first component, a second component, and an actuating piece arranged on the mounting base; the second component and the first component are movable with respect to each other; the actuating piece is located in one of the first component and the second component; and when the actuating piece is moved from a first position to a second position responsive to relative movement of the first component and the second component, the second fitting is driven to move from an initial position to the stop position.

2. The furniture assembly of claim 1, wherein the second fitting is movably arranged on the mounting base.

3. The furniture assembly of claim 2, wherein the direction of relative movement of the first component and the second component is different from the direction of displacement of the actuating piece from the first position to the second position.

4. The furniture assembly of claim 2, wherein the second fitting includes a guide section through which the actuating piece can drive the second fitting to move, in which the guide section is a bevel face or a cambered surface.

5. A furniture assembly, comprising:

a first furniture piece;

a second furniture piece movable with respect to the first furniture piece; and a safety device, including:

a first fitting detachably coupled to one of the first furniture piece and the second furniture piece; and a second fitting detachably coupled to the other one of the first furniture piece and the second furniture piece;

wherein when the second fitting is at a stop position, the first fitting is blocked by the second fitting so that the second furniture piece is stopped from moving in a first direction with respect to the first furniture piece;

wherein the second fitting is detachably coupled to the other one of the first furniture piece and the second furniture piece through a mounting base, the second fitting being movably arranged on the mounting base;

wherein the first fitting includes a first stopping part and a second stopping part; a space (S) is defined between the first stopping part and the second stopping part; and a portion of the second fitting protrudes into the space (S) when the second fitting is at the stop position, so as to block one of the first stopping part and the second stopping part.

6. The furniture assembly of claim 5, wherein when the second furniture piece is moved in a second direction to a predetermined position with respect to the first furniture piece, the other one of the first stopping part and the second stopping part contacts the second fitting and drives the second fitting to depart from the stop position.

7. The furniture assembly of claim 6, wherein the second fitting includes a guide feature through which the other one of the first stopping part and the second stopping part can drive the second fitting to depart from the stop position; and the guide feature is a bevel face or a cambered surface.

8. A furniture assembly, comprising:

a first furniture piece;

a second furniture piece movable with respect to the first furniture piece; and a safety device including a first fitting and a second fitting, wherein one of the first fitting and the second fitting is detachably coupled to one of the first furniture piece and the second furniture piece, and the other one of the first fitting and the second fitting is located on the other one of the first furniture piece and the second furniture piece;

wherein when the second fitting is at a stop position, the first fitting is blocked by the second fitting so that the second furniture piece is stopped from moving in a first direction with respect to the first furniture piece;

wherein the second fitting is detachably coupled to the first furniture piece through a mounting base;

wherein the safety device further includes a first component, a second component and an actuating piece arranged on the mounting base; the second component and the first component are movable with respect to each other; the actuating piece is located in one of the first component and the second component and is movable from a first position to a second position responsive to relative movement of the first component and the second component, so as to drive the second fitting to move from an initial position to the stop position.

9. The furniture assembly of claim 8, wherein the first fitting is detachably coupled to the second furniture piece.

10. The furniture assembly of claim 9, wherein the second fitting is movably arranged on the mounting base.

11. The furniture assembly of claim 10, wherein the direction of relative movement of the first component and the second component is different from the direction of displacement of the actuating piece from the first position to the second position.

12. The furniture assembly of claim 10, wherein the second fitting includes a guide section through which the actuating piece can drive the second fitting to move, in which the guide section is a bevel face or a cambered surface.

13. The furniture assembly of claim 10, wherein the first fitting includes a first stopping part and a second stopping part; a space (S) is defined between the first stopping part and the second stopping part; and a portion of the second fitting protrudes into the space S when the second fitting is at the stop position, so as to block one of the first stopping part and the second stopping part.

14. The furniture assembly of claim 13, wherein when the second furniture piece is moved in a second direction D2 to a predetermined position with respect to the first furniture piece, the other one of the first stopping part and the second stopping part contacts the second fitting and drives the second fitting to depart from the stop position.

15. The furniture assembly of claim 14, wherein the second fitting includes a guide feature through which the other one of the first stopping part and the second stopping part can drive the second fitting to depart from the stop position; and the guide feature is a bevel face or a cambered surface.

16. A furniture assembly, comprising:

a first furniture piece;

a second furniture piece movable with respect to the first furniture piece; and a safety device including a first fitting and a second fitting, wherein one of the first fitting and the second fitting is detachably coupled to one of the first furniture piece and the second furniture piece, and the other one of the first fitting and the second fitting is located on the other one of the first furniture piece and the second furniture piece;

wherein the first fitting includes a first stopping part and a second stopping part, and a space (S) is defined between the first stopping part and the second stopping part;

wherein when the second furniture piece is at a closing position (P) with respect to the first furniture piece, the second stopping part of the first fitting corresponds in position to a portion of the second fitting, so that the second fitting is kept in an initial position;

wherein when the second furniture piece is moved in a first direction with respect to the first furniture piece due to a force applied on the furniture assembly and thereby departs from the closing position (P), the second stopping part of the first fitting does not correspond in position to the portion of the second fitting anymore, so that the second fitting moves from the initial position to a stop position responsive to the force, and that the portion of the second fitting protrudes into the space (S) of the first fitting to block the first stopping part, thereby stopping the second furniture piece from moving in the first direction with respect to the first furniture piece.

17. The furniture assembly of claim 16, wherein when the second furniture piece moves in a second direction to a predetermined position with respect to the first furniture piece, the second stopping part contacts the portion of the second fitting and drives the second fitting from the stop position to return to the initial position.

* * * * *